US009530422B2

(12) United States Patent
Klejsa et al.

(10) Patent No.: US 9,530,422 B2
(45) Date of Patent: Dec. 27, 2016

(54) BITSTREAM SYNTAX FOR SPATIAL VOICE CODING

(71) Applicants: Dolby Laboratories Licensing Corporation, San Francisco, CA (US); DOLBY INTERNATIONAL AB, Amsterdam Zuidoost (NL)

(72) Inventors: Janusz Klejsa, Bromma (SE); Leif Jonas Samuelsson, Sundbyberg (SE); Heiko Purnhagen, Sundbyberg (SE); Glenn N. Dickins, Como (AU)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 14/392,287

(22) PCT Filed: Jun. 26, 2014

(86) PCT No.: PCT/US2014/044295
§ 371 (c)(1),
(2) Date: Dec. 23, 2015

(87) PCT Pub. No.: WO2014/210284
PCT Pub. Date: Dec. 31, 2014

(65) Prior Publication Data

US 2016/0155447 A1 Jun. 2, 2016

Related U.S. Application Data

(60) Provisional application No. 61/839,989, filed on Jun. 27, 2013.

(51) Int. Cl.
*G10L 19/00* (2013.01)
*G10L 19/008* (2013.01)
(Continued)

(52) U.S. Cl.
CPC ..... *G10L 19/008* (2013.01); *G10L 19/002* (2013.01); *G10L 19/0204* (2013.01);
(Continued)

(58) Field of Classification Search
CPC .... G10L 19/008; G10L 19/00; G10L 19/0212; G10L 19/002; G10L 19/02; G10L 19/032; G10L 19/24; H04N 19/61; H04B 1/66; H04H 20/88; H04S 3/00
(Continued)

(56) References Cited

U.S. PATENT DOCUMENTS 5,247,579 A 9/1993 Hardwick
7,420,935 B2 9/2008 Virolainen
(Continued)

FOREIGN PATENT DOCUMENTS

EP 1400955 3/2004
WO 2006/111294 10/2006
(Continued)

OTHER PUBLICATIONS

Jelinek, M. et al "G.718: A New Embedded Speech and Audio Coding Standard with High Resilience to Error-Prone Transmission Channels" IEEE Communications Society, Oct. 2009, pp. 117-123.
(Continued)

*Primary Examiner* — Vijay B Chawan

(57) ABSTRACT

An encoding system (100) encodes a first (E1) and further (E2, E3) audio signals as a layered bitstream (B), wherein a quantizer for each frequency band of each signal is selected using a rate allocation rule based on signal-specific rate allocation data, a spectral envelope of the signal and a reference level (EnvE1Max), which is determined based on the spectral envelope of the first signal and is not necessarily included in the bitstream. Further disclosed is a decoding system for reconstructing the audio signals based on the
(Continued)

bitstream. In embodiments, the bitstream has a basic layer ($B_{E1}$), which contains data that enable decoding of the first audio signal, and a spatial layer ($B_{spatial}$) facilitating decoding of the further audio signal(s). In embodiments, the encoding system prepares the bitstream subject to a basic-layer bitrate constraint and a total bitrate constraint.

22 Claims, 6 Drawing Sheets

(51) Int. Cl.
*G10L 19/032* (2013.01)
*G10L 19/002* (2013.01)
*G10L 19/02* (2013.01)
*G10L 19/035* (2013.01)

(52) U.S. Cl.
CPC ..... *G10L 19/0212* (2013.01); *G10L 19/032* (2013.01); *G10L 19/035* (2013.01)

(58) Field of Classification Search
USPC ..... 704/229, 230, 200.1, 500–504, 204, 205,704/206; 375/240.07, 240.11, 240.25; 381/22, 381/23, 17, 18, 19, 20, 21, 28, 27, 307
See application file for complete search history.

(56) References Cited

U.S. PATENT DOCUMENTS 8,050,914 B2 11/2011 Schmidt
8,063,809 B2 11/2011 Liu
8,204,261 B2 6/2012 Allamanche
8,341,672 B2 12/2012 Civanlar
8,359,194 B2 1/2013 Briand
8,804,971 B1 * 8/2014 Williams ..... G10L 19/008 704/500
2005/0159946 A1 * 7/2005 Chen ..... G10L 19/24 704/229
2007/0225842 A1 * 9/2007 Smith ..... H04S 3/00 700/94
2008/0021704 A1 * 1/2008 Thumpudi ..... G10L 19/008 704/230
2008/0068446 A1 3/2008 Barkley
2009/0198500 A1 8/2009 Garudadri
2010/0169080 A1 7/2010 Tsuchinaga
2010/0198589 A1 8/2010 Ishikawa
2010/0318368 A1 * 12/2010 Thumpudi ..... G10L 19/032 704/500
2011/0035212 A1 2/2011 Brian
2011/0046945 A1 2/2011 Lite
2011/0091045 A1 4/2011 Schuijers
2011/0154417 A1 6/2011 Civanlar
2011/0224994 A1 9/2011 Norvell
2011/0295598 A1 12/2011 Yang
2012/0035941 A1 * 2/2012 Thumpudi ..... G10L 19/008 704/500
2012/0053949 A1 3/2012 Sasaki
2012/0057715 A1 3/2012 Johnston
2012/0082316 A1 * 4/2012 Thumpudi ..... G10L 19/008 381/22
2012/0101826 A1 4/2012 Visser
2012/0243692 A1 9/2012 Ramamoorthy
2012/0324521 A1 12/2012 Rhyu
2013/0144630 A1 * 6/2013 Thumpudi ..... G10L 19/008 704/500
2015/0221313 A1 8/2015 Purnhagen
2015/0221319 A1 8/2015 Cartwright
2015/0248889 A1 9/2015 Dickins
2015/0356978 A1 12/2015 Dickins

FOREIGN PATENT DOCUMENTS

WO 2008/106036 9/2008
WO 2010/003556 1/2010

OTHER PUBLICATIONS

Tzagkarakis, C. et al "A Multichannel Sinusoidal Model Applied to Spot Microphone Signals for Immersive Audio" IEEE Transactions on Audio, Speech and Language Processing, vol. 17, No. 8, pp. 1483-1497, Nov. 2009.
ITU-T, G.729.1 G.729-Based Embedded Variable Bit-Rate Coder: An 8-32 kbit/s Scalable Wideband Coder Bitstream Interoperable with G.729, Mar. 2010, Amendment 6: New Annex E on Superwideband Scalable Extension.
ITU-T, G.729.1 G.729-Based Embedded Variable Bit-Rate Coder: An 8-32 kbit/s Scalable Wideband Coder Bitstream Interoperable with G.729, Feb. 2012, Amendment 7: New Annex F with Voice Activity Detector Using ITU-T G.720.1, Annex A.
Yang, D. et al "High-Fidelity Multichannel Audio Coding with Karhunen-Loeve Transform" IEEE Transactions on Speech and Audio Processing, vol. 11, No. 4, Jul. 2003, pp. 365-380.

* cited by examiner

BITSTREAM SYNTAX FOR SPATIAL VOICE CODING

CROSS-REFERENCE TO RELATED APPLICATIONS

This application claims priority to U.S. Provisional Application No. 61/839,989, filed on 27 Jun. 2013, incorporated herein by reference in its entirety.

The present patent application is also related to the following applications: International Patent Application No. PCT/US2013/059025 filed 10 Sep. 2013; International Patent Application No. PCT/US2013/059144 filed 11 Sep. 2013; International Patent Application No. PCT/US2013/059295 filed 11 Sep. 2013; and International Patent Application No. PCT/EP2013/069607 filed 20 Sep. 2013. These related applications describe systems and methods for selecting layer(s) of a spatially layered, encoded audio signal to be transmitted to, or rendered by, at least one endpoint of a teleconferencing system, and the description in said referenced application of each such system and method is incorporated herein by reference in its entirety.

TECHNICAL FIELD OF THE INVENTION

The invention disclosed herein generally relates to multichannel audio coding and more precisely to bitstream syntax for scalable discrete multichannel audio. The invention is particularly useful for coding of audio signals in a teleconferencing or videoconferencing system with endpoints having non-uniform audio rendering capabilities.

BACKGROUND OF THE INVENTION

Available tele- and videoconferencing systems have limited abilities to handle sound field signals, e.g., signals in a spatial sound field captured by an array of three or more microphones, artificially generated sound field signals, or signals converted into a sound field format, such as B-format, G-format, Ambisonics™ and the like. The use of sound field signals makes a richer representation of the participants in a conference available, including their spatial properties, such as direction of arrival and room reverb. The referenced applications disclose sound field coding techniques and coding formats which are advantageous for tele- and videoconferencing since any inter-frame dependencies can be ignored at decoding and since mixing can take place directly in the transform domain.

It would be desirable to provide an audio coding format allowing at least a simpler and a more advanced decoding mode (e.g., decoding into mono audio and decoding into some spatial format) while eliminating unnecessary processing and/or transmission of data when the simpler decoding mode is the relevant one. The referenced application by Cartwright et al. describes a layered coding format and a conferencing server with stripping abilities, e.g., a server adapted to handle packets susceptible to both relatively simpler decoding and more advanced decoding, by routing only a basic layer of each packet to conferencing endpoints with simpler audio rendering capabilities. It would be desirable for the stream of complete packets to fulfil a first bitrate constraint and for the stream of stripped packets (the basic layer and any header structures and the like) to fulfil a second bitrate constraint at all times. Finally, it would be desirable for the audio coding format to approach the coding efficiency of non-layered formats.

BRIEF DESCRIPTION OF THE DRAWINGS

Example embodiments will now be described with reference to the accompanying drawings, on which.

All the figures are schematic and generally only show parts which are necessary in order to elucidate the invention, whereas other parts may be omitted or merely suggested. Unless otherwise indicated, like reference numerals refer to like parts in different figures.

DETAILED DESCRIPTION OF THE INVENTION

I. Overview

Figure 1:
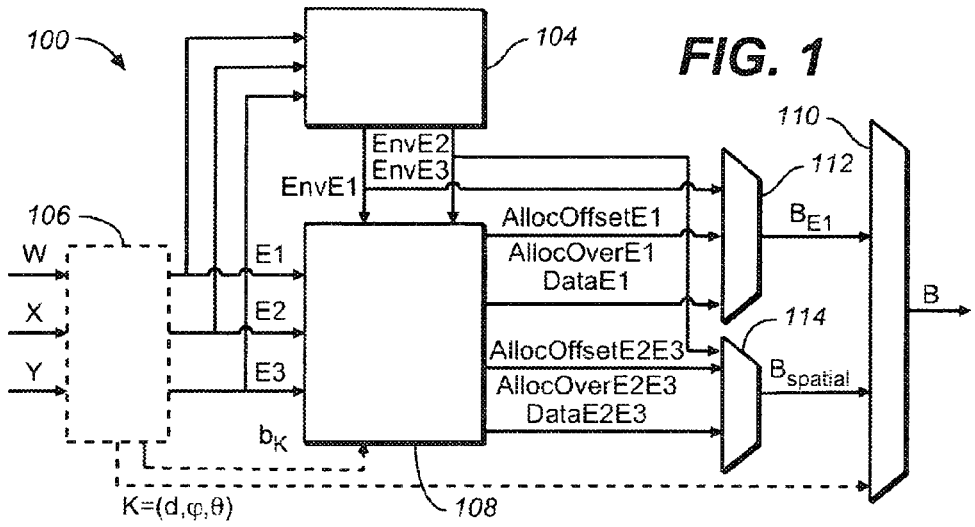
FIG. 1 is a generalized block diagram of an audio encoding system according to an example embodiment.

As used herein, an audio signal may refer to a pure audio signal, an audio part of a video signal or multimedia signal, or an audio signal part of a complex audio object, wherein an audio object may further comprise or be associated with positional or other metadata. The present disclosure is generally concerned with methods and devices for converting from a plurality of audio signals into a bitstream encoding the audio signals (encoding) and back (decoding or reconstruction). The conversions are typically combined with distribution, whereby decoding takes place at a later point in time than encoding and/or in a different spatial location and/or using different equipment.

An audio encoding system receives a first audio signal and at least one further audio signal and encodes the audio signals as at least one outgoing bitstream. The audio encoding system in scalable in the sense that the bitstream it produces allows reconstruction of either all encoded (first and further) audio signals or the first audio signal only. The audio encoding system comprises an envelope analyzer, a multichannel encoder and a multiplexer. The envelope analyzer prepares spectral envelopes for the first and further audio signals. The multichannel encoder performs rate allocation for each audio signal, which produces first and second rate allocation data as output, which indicate, for the frequency bands in each audio signal, a quantizer to be used for that frequency band. The quantizers are preferably selected from a collection of predefined quantizers, relevant parts which are accessible both on the encoding side and the decoding side of a transmission or distribution path. The multichannel encoder in the audio encoding system further quantizes the audio signal, whereby signal data are obtained. A multiplexer prepares a bitstream that comprises the spectral envelopes, the signal data and the rate allocation data, which forms the output of the audio encoding system.

In an example embodiment, the multichannel encoder in the audio encoding system comprises a rate allocation component applying a first rate allocation rule, indicating the quantizers to be used for generating the signal data for the first audio signal, and a second rate allocation rule, indicating the quantizers to be used for generating the signal data for the at least one further audio signal. The first rate allocation rule determines a quantizer label (referring to a collection of quantizers) for each frequency band of the first audio signal on the basis of the first rate allocation data and the spectral envelope of the first audio signal; and the second rate allocation rule determines a quantizer label for each frequency band of the at least one further audio signal on the basis of the second rate allocation data and the spectral envelope of the at least one further audio signal. Additionally, both the first and second rate allocation rules depend on a reference level derived from the spectral envelope of the first audio signal. The reference level is computed by applying a predefined non-zero functional to the spectral envelope of the first audio signal.

Because the functional is predefined, the reference level can be recomputed on the basis of the bitstream independently in a different entity, such as an audio decoding system reconstructing the first and further audio signals, and therefore does not need to be included in the bitstream. Moreover, because the reference level is computed based on the spectral envelope of the first audio signal only, then, in a layered signal separating the first audio signal from the further audio signal(s), the layer with the first audio signal is sufficient to compute the reference level on the decoder side. Hence, the rate allocation determined at the encoder for the first signal can be also determined at the decoder even if the spectral envelopes for the further audio signals are not available. In other words, the assumption on the reference level makes it possible to decode the rate allocation also in the context of layered decoding. Because the reference level is based on one signal only (the spectral envelope of the first audio signal), it is cheaper to compute than if a larger input data set had been used; for instance, a rate allocation criterion involving the global maximum in all spectral envelopes is disclosed in International Patent Application No. PCT/EP2013/069607.

The method according to the above example embodiment is able to encode a plurality of audio signals with limited amount of data, while still allowing decoding in either mono or spatial format, and is therefore advantageous for teleconferencing purposes where the endpoints have different decoding capabilities. The encoding method may also be useful in applications where efficient, particularly bandwidth-economical, scalable distribution formats are desired.

In an example embodiment, the reference level is derived from the first audio signal using a non-constant functional. In particular, said non-constant functional may be a function of the spectral envelope values of the first audio signal.

In an example embodiment, the only frequency-variable contribution in the first and/or second rate allocation rule is the spectral envelope of the first and second audio signal, respectively. In particular, the rule may refer, for a given frequency band, to the value of the spectral envelope in that frequency band, while the rate allocation data and/or the reference level are constant across all frequency bands. Put differently, one or more of the allocation rules depend parametrically on the rate allocation data and/or the reference level.

In an example embodiment, the predefined non-zero functional is a maximum operator, extracting from a spectral envelope a maximum spectral value. If the spectral envelope is made up by frequency band-wise energies, then the maximum operator will return, as the reference level, the energy of the frequency band with the maximal energy (or peak energy). An advantage of using the maximum as reference level is that the maximal energy and the spectral envelope are of a similar order of magnitude, so that their difference stays reasonably close to zero and is reasonably cheap to encode. In cases where the audio signals result by an energy-compacting transform, which tends to concentrate the signal energy to the first audio signal, it is also true in normal circumstances that the reference level minus the spectral envelopes of one of the further audio signals will be close to zero or a small positive number. Further, the maximum can be computed by successive comparisons, without requiring arithmetic operations which may be more costly. Furthermore, the usage of maximum level of the envelope of the first audio signal has been found to be a perceptually efficient rate allocation strategy, as it leads to selection of quantizers that distributes distortion in a perceptually efficient way even if coding resources are shared among the first audio signal and the further audio signal(s).

In an example embodiment, the predefined non-zero functional is proportional to a mean value operator (i.e., a sum or average of signed band-wise values of the first spectral envelope) or a median operator. An advantage of using the mean value or median as reference level is that this value and the spectral envelope are of a of a similar order of magnitude, so that their difference stays reasonably close to zero and is reasonably cheap to encode.

In an example embodiment, the audio encoding system is configured to output a layered bitstream. In particular, the bitstream may comprise a basic layer and a spatial layer, wherein the basic layer comprises the spectral envelope and the signal data of the first audio signal and the first rate allocation data, and allows independent reconstruction of the first audio signal. The spatial layer allows reconstruction of the further audio signals, at least if the basic layer can be relied upon. In particular, the spatial layer may express properties of the at least one further audio signal recursively with reference to the first audio signal or with reference to data encoding the first audio signal. The multiplexer in the audio encoding system may be configured to output a bitstream comprising bitstream units corresponding to one or more time frames of the audio signals, in which the spectral envelope and signal data of the first audio signal and the first rate allocation data are non-interlaced with the spectral envelopes and signal data of the at least one further audio signal and the second rate allocation data in each bitstream unit. In particular, the first rate allocation data and the spectral envelope and signal data of the first audio signal may precede the second rate allocation data and the spectral envelopes and signal data of the at least one further audio signal in each bitstream unit.

In a further development of this example embodiment, the rate allocation component is configured to determine a first coding bitrate (as measured in bits per time frame, bits per unit signal duration and the like) occupied by the basic layer and to enforce a basic-layer bitrate constraint. The basic-layer bitrate constraint can be enforced by choosing the first rate allocation data in such manner that the determined first coding bit rate does not exceed the constraint. The determination of the first coding bitrate may be implemented as a measurement of the bitrate of the basic layer of the actual bitstream. Alternatively, if it is inconvenient to determine the first coding bitrate in this manner (e.g., if the basic layer of the bitstream is prepared in a component of the audio encoding system with poor abilities to communicate with the rate allocation component), the rate allocation component may be rely on an approximate estimate of the bitrate of the basic layer of the bitstream in order to enforce the basic-layer bitrate constraint. Alternatively or additionally, the rate allocation component may apply a similar approach to determine a total coding bitrate occupied by the bitstream (including the contribution of the basic layer and the spatial layer); this way, the rate allocation component may determine the first and second rate allocation data while enforcing a total bitrate constraint.

In an example embodiment, the rate allocation component operates on audio signals with flattened spectra, where the flattened spectra are obtained by normalizing the first audio signal by using the first envelope as guideline and normalizing the at least one further audio signal by their respective spectral envelopes. The normalization may be designed to return modified versions of the first and further audio signals having flatter spectra.

A decoder counterpart of the example embodiment may, upon determining the rate allocation and performing inverse quantization, apply de-flattening (inverse flattening) that reconstructs the audio signals with a coloured (less flat) spectrum. Analogously to the audio encoding system, the decoder counterpart de-flattens the signals by using their respective spectral envelopes as guideline.

In an example embodiment, the predefined quantizers in the collection are labelled with respect to fineness order. For instance, each quantizer may be associated with a numeric label which is such that the next quantizer in order will have at least as many quantization levels (or, by a different possible convention, at most as number of quantization levels) and thus be associated with at least (or, by the opposite convention, at most) the same bitrate cost and at most (or, by the opposite convention, at least) the same distortion. Then, the quantizer can be selected in accordance with the energy content of a frequency band, namely by selecting a quantizer that carries a label which is positively correlated with (e.g., proportional to) the energy content. It is important to note that the fineness in this sense does not necessarily correlate with the average or maximal quantization step size, but refers to the total number of quantization levels. The collection of quantizers may include a zero-rate quantizer; the frequency bands encoded by a zero-rate quantizer may be reconstructed by noise filling (e.g., up to the quantization noise floor, possibly taking masking effects into account) at decoding.

In further developments, the label of the selected quantizer may be proportional to a band-wise energy content normalized by (e.g., additively adjusted by) the reference level.

Additionally or alternatively, the label of the selected quantizer is proportional to a band-wise energy content normalized by (e.g., additively adjusted by) an offset parameter in the rate allocation data.

Additionally or alternatively, the rate allocation data may include an augmentation parameter indicating a subset of frequency bands for which the outcome (quantizer label) of the first or second rate allocation rule is to be overridden. For example, the overriding may imply that a quantizer that is finer by one unit is chosen for the indicated frequency bands. In a situation where the remaining bitrate headroom is not enough to increase the offset parameter by one unit, the remaining bitrate may be spent on the lower frequency bands, which will then be encoded by quantizers one unit finer than the rate allocation rule defines. This decreases the granularity of the rate allocation process. It may be said that the offset parameter can be used to for coarse control of the coding bitrate allocation, whereas the augmentation parameter can be used for finer tuning.

If both the first and second rate allocation data contain offset parameters, which can be assigned values independently of one another, it may be suitable to encode the offset parameter in the second rate allocation data conditionally upon the offset parameter in the first rate allocation data. For instance, the offset parameter in the second rate allocation data may be encoded in terms of its difference with respect to the offset parameter in the first rate allocation data. This way, the offset parameter in the first rate allocation data can be reconstructed independently on the decoder side, and the second offset parameter may be coded more efficiently Example embodiments include techniques for efficient encoding of the rate allocation data. For instance, where the first rate allocation data include a first offset parameter and the second rate allocation data include a second offset parameter, the multichannel encoder may decide to set the first and second offset parameters equal. This is to say, the first and the second rate allocation rules differ in terms of the spectral envelope used (i.e., whether it relates to the first audio signal or a further audio signal) but not in terms of the reference level and the offset parameter. The multichannel encoder may reduce the search space and reach a reasonable decision in limited time by searching only among rate allocation decisions (expressed as offset parameters) where the first and second offset parameters are equal and only the augmentation parameter is adjusted on a per layer basis. In such a situation, an explicit value of the second offset parameter may be omitted from the bitstream and replaced by a copy flag (or field) indicating that the first offset parameter replaces the second offset parameter. In a bitstream with a basic layer (enabling reconstruction of the first audio signal) and a spatial layer (enabling reconstruction, possibly with the aid of data in the basic layer, of the at least one further audio signals), the copy flag is preferably located in the spatial layer. If the flag is set to its negative value (indicating that the first offset parameter does not replace the second offset parameter), the bitstream preferably includes the second offset value—either expressed as an explicit value or in terms of a difference with respect to the first offset value—in the spatial layer. The copy flag may be set once per time frame or less frequently than that.

The above embodiment is also practically relevant to the case:

- where the encoder operates with two bit-rate constraints, namely a basic-layer constraint on the first layer and a total constraint on the total number of bits in all the layers, and
- where the rate allocation procedure saturates for the first audio signal due to hitting the basic-layer constraint, but spending less bits than the total number of allowed bits, yielding a number of remaining available bits, and
- where the encoder can avoid spending the remaining available bits for refining the further signals, but rather leave them for other components of the teleconferencing system.

Example embodiments define suitable algorithm for satisfying dual bitrate constraints. For instance, the audio encoding system may be configured to provide a bitstream where a basic layer satisfies a basic-layer bitrate constraint, while the bitstream as a whole satisfies a total bitrate constraint.

An example embodiment relates to an audio encoding method including the operations performed by the audio encoding system described above.

A second aspect relates to methods and devices for reconstructing the first audio signal and optionally also the further audio signal(s) on the basis of the bitstream.

According to an example embodiment, a multichannel audio decoding system adapted to reconstruct a first and at least one further audio signal on the basis of data in a bitstream comprises a multichannel decoder, in which an inverse quantizer selector indicates, for each frequency band of the first and further audio signals, an inverse quantizer in a collection of inverse quantizers. In the multichannel decoder, further, a dequantization component uses the inverse quantizers thus indicated to reconstruct each frequency band of the first and further audio signals on the basis of signal data for these audio signals. It is understood that the bitstream encodes at least signal data and spectral envelopes for the first and further audio signals, as well as first and second rate allocation data. In some implementations, the signal data may not be extracted from the bitstream without knowledge of the inverse quantizers (or labels identifying the inverse quantizers); as such, a "demultiplexer" in the sense of the appended claims may be a distributed entity, possibly including a dequantization component, which possess the requisite knowledge and receives the bitstream. The audio decoding system is characterized by a processing component implementing a predefined non-zero functional, which derives a reference level from the spectral envelope of the first audio signal and supplies the reference level to the inverse quantizer. Hence, even though the reference level is typically computed on the encoding side, the reference level may be left out of the bitstream to save bandwidth or storage space. The inverse quantizer implements a first rate allocation rule and a second rate allocation rule equivalent to the first and second rate allocation rules described previously in connection with the audio encoding system. A such, the first rate allocation rule determines an inverse quantizer for each frequency band of the first audio signal, on the basis of the spectral envelope of the first audio signal, the reference level and one or more parameters in first rate allocation data received in the bitstream. The second rate allocation rule, which is responsible for indicating inverse quantizers for the at least one further audio signal, makes reference to the spectral envelope of the at least one further audio signals, to the second rate allocation data and to the reference level, which is derived from the spectral envelope of the first audio signal, as already described.

According to an example embodiment, a mono audio decoding system for reconstructing a first audio signal on the basis of a bitstream comprises a mono decoder configured to select inverse quantizers in accordance with a first rate allocation rule, by which first rate allocation data, the spectral envelope of the first audio signal—both quantities being extractable from the bitstream—and a reference level derived from the spectral envelope of the first audio signal determine an inverse quantizer for each frequency band of the first audio signal. The inverse quantizer thus indicated is used to reconstruct the frequency bands of the first audio signals by dequantizing signal data comprising quantization indices (or codewords associated with the quantization indices). Again, in some implementations of the mono audio decoding system, the signal data may not be extractable from the bitstream without knowledge of the inverse quantizers (or labels identifying the inverse quantizers), which is why a "demultiplexer" in the appended claims may refer to a distributed entity. For instance, a dequantization component may extract the signal data and thereby act as a demultiplexer in some sense. The mono audio decoding system is layer-selective in that it omits, disregards or discards any data relating to other encoded audio signals than the first audio signal. As described in the referenced International Patent Application No. PCT/US2013/059295 and International Patent Application No. PCT/US2013/059144, the discarding of the data relating to other signals than the first audio signals may alternatively be performed in a conferencing server supporting the endpoints in a tele- or video-conferencing communication network. In the alternative case, if the mono audio decoding system is arranged in a conferencing endpoint, there will be no more data left in the bitstream units for the mono audio decoding system strip off.

In particular, the mono audio decoding system may be configured to reconstruct the first audio signal based on a bitstream comprising a basic layer and a spatial layer, wherein the basic layer comprises the spectral envelope and the signal data of the first audio signal, as well as the first rate allocation data; the mono audio decoding system may then be configured to discard the spatial layer. In particular, a demultiplexer in the mono audio decoding system may be configured to discard a later portion (i.e., truncating the bitstream unit), carrying data relating to the at least one further audio signals, of each received bitstream unit. The later portion may correspond to a spatial layer of the bitstream.

Alone, the decoding techniques according to the above example embodiment allow faithful reconstruction of the first audio signal or, depending on the capabilities of the receiving endpoint, of the first and further audio signals, based on a limited amount of input data. Together with the encoding method previously discussed, the decoding method is suitable for use in a teleconferencing or video conferencing network. More generally, the combination of the encoding and decoding may be used to define an efficient scalable distribution format for audio data.

In an example embodiment, a multichannel audio decoding system may have access to a collection of predefined quantizers ordered with respect to fineness. The first and/or the second rate allocation rule in the multichannel decoder may be designed to select a quantizer with relatively more quantization levels for frequency bands with a relatively greater energy content (values in the respective spectral envelope). However, although the rate allocation rules in combination with the definition of the collection of quantizers will typically allocate finer quantizers (quantizers with a greater number of quantization steps) for frequency bands with a larger energy content, this does not necessarily imply that a given difference in energy between two frequency bands is accompanied by a linearly related difference in signal-to-noise ratio (SNR). For instance, example embodiments may react to a difference in spectral envelope values of 6 dB by assigning quantizers differing by a mere 3 dB in SNR. In other words, the first and/or the second rate allocation rule may allow for relatively more distortion under spectral peaks and relatively less distortion for spectral valleys. Optionally, the first and/or second rate allocation rule is/are designed to normalize the respective spectral envelope by the reference level derived from the spectral envelope of the first audio signal. Additionally or alternatively, the first and/or second rate allocation rule is/are designed to normalize the respective spectral envelope by an offset parameter in the respective rate allocation data. Further, the rate-allocation rule may be applied to a flattened spectrum of a signal, where the flattening was obtained by normalization of the spectrum by the respective envelope values.

In an example embodiment, a multichannel audio decoding system is configured to decode (parts of) the second rate allocation data, in particular an offset parameter, differentially with respect to the first rate allocation data. In particular, the audio decoding system may be configured to read a copy flag indicating whether or the offset parameter in the second rate allocation data is different from or equal to the offset parameter in the first rate allocation data in a given time frame; in the latter case the audio decoding system may refrain from decoding the offset parameter in the second rate allocation data in that time frame.

In an example embodiment, a multichannel audio decoding system is configured to handle a bitstream comprising an augmentation parameter of the type described above in connection with the audio encoding system.

In an example embodiment, a multichannel audio decoding system is configured to reconstruct at least one frequency band in the first or further audio signals by noise filling. The noise filling may be guided by a quantization noise floor indicated by the spectral envelope, possibly taking perceptual masking effects into account.

In an example embodiment, a multichannel audio decoding system is configured to decode the spectral envelope of the at least one further audio signal differentially with respect to the spectral envelope of the first audio signal. In particular, the frequency bands of the spectral envelopes of the at least one further audio signal may be expressed in terms of its (additive) difference with respect to corresponding frequency bands in the first audio signal.

In an example embodiment, a mono audio decoding system comprises a cleaning stage for applying a gain profile to the reconstructed first audio signal. The gain profile is time-variable in that it may be different for different bitstream units or different time frames. The frequency-variable component comprised in the gain profile is frequency-variable in the sense that it may correspond to different gains (or amounts of attenuation) to be applied to different frequency bands of the first audio signal. The frequency-variable component may be adapted to attenuate non-voice content in audio signals, such as noise content, sibilance content and/or reverb content. For instance, it may clean frequency content/components that are expected to convey sound other than speech. The gain profile may comprise separate sub-components for different functional aspects. For example, the gain profile may comprise frequency-variable components from the group comprising: a noise gain for attenuating noise content, a sibilance gain for attenuating sibilance content, and a reverb gain for attenuating reverb content. The gain profile may comprise a time-variable broadband gain which may implement aspects of dynamic range control, such as levelling, or phrasing in accordance with utterances. For example, the gain profile may comprise (time-variable) broadband gain components, such as a voice activity gain for performing phrasing and/or voice activity gating and/or a level gain for adapting the loudness/level of the signals (e.g. to achieve a common level for different signals, for example when forming a combined audio signal from several different audio signals with different loudness/level).

In example embodiment, both a multichannel and a mono audio decoding system may comprise a de-flattening component, which restores the audio signals with a coloured spectrum, so as to cancel the action of a corresponding flattening component on the encoder side.

In an example embodiment, a multichannel audio decoding method comprises:

receiving spectral envelopes of a first and further audio signals, signal data (e.g., quantization indices of all or a subset of the frequency bands) of the first and further audio signals and first and second rate allocation data;

indicating an inverse quantizer for each frequency band of the first and further audio signals, including applying a first and a second rate allocation rule, both referring to a reference level derived from the spectral envelope of the first audio signal, as described above; and reconstructing the frequency bands of the first and further audio signals by processing the signal data using the indicated inverse quantizers.

In an example embodiment, a mono audio decoding method comprises:

receiving spectral envelopes of a first audio signal, signal data (e.g., quantization indices of all or a subset of the frequency bands) of the first audio signal and first rate allocation data, while disregarding or discarding possible further data which is received concurrently but relate to other signals than the first audio signal;

indicating an inverse quantizer for each frequency band of the first audio signal, including applying a first rate allocation rule referring to a reference level derived from the spectral envelope of the first audio signal, as described above; and reconstructing the frequency bands of the first audio signal by processing the signal data using the indicated inverse quantizers.

Further example embodiments include: a computer program for performing an encoding or decoding method as described in the preceding paragraphs; a computer program product comprising a computer-readable medium storing computer-readable instructions for causing a programmable processor to perform an encoding or decoding method as described in the preceding paragraphs; a computer-readable medium storing a bitstream obtainable by an encoding method as described in the preceding paragraphs; a computer-readable medium storing a bitstream, based on which an audio scene can be reconstructed in accordance with a decoding method as described in the preceding paragraphs. It is noted that also features recited in mutually different claims can be combined to advantage unless otherwise stated.

II. Example Embodiments

The technological context of the present invention can be understood more fully from the related international patent applications initially referenced.

FIG. 1 shows an audio encoding system 100 with a combined spatial analyzer and adaptive rotation stage 106 (optional), a multichannel encoder 108 supported by an envelope analyzer 104, and a multiplexer with three sub-multiplexers 110, 112, 114. In the embodiment shown, the audio encoding system 100 is configured to receive three input audio signals W, X, Y and to output a bitstream B with data for reconstructing, on a decoder side, the audio signals. Audio encoding systems 100 for processing two input audio signals, four input audio signals or higher numbers of input audio signals are evidently included in the scope of protection; there is also no requirement that the input audio signals be statistically correlated, although this may enable coding at a relatively lower bitrate.

The combined spatial analyzer and adaptive rotation stage 106 is configured to map the input audio signals W, X, Y by a signal-adaptive orthogonal transformation into audio signals E1, E2, E3. Quantitative properties of the orthogonal transformation are determined by a vector of decomposition parameters K=(d, ϕ, θ), as described in greater detail in International Patent Application No. PCT/EP2013/069607, which parameters are also output from the combined spatial analyzer and adaptive rotation stage 106 and included, by a final multiplexer 110, in the outgoing bitstream B. Preferably, it is possible to assign new independent values to the decomposition parameters (d, ϕ, θ) for each time frame, based on an analysis of the input audio signals W, X, Y in that time frame. Further, it is advantageous if the orthogonal transformation has energy-compacting properties, tending to concentrate the total signal energy in the first audio signal E1. Such properties are attributed to the Karhunen-Loéve transform. The efficiency of the energy concentration will typically be noticeable—i.e., the relative difference in energy content between the first audio signal E1 on the one hand and the further audio signals E2, E3 on the other—at times when the input audio signals W, X, Y are statistically correlated to some extent, e.g., when the input audio signals W, X, Y relate to different channels representing a common audio content, as is the case when an audio scene is recorded by microphones located in distinct locations in or around the audio scene. It is emphasized that the combined spatial analyzer and adaptive rotation stage 106 is an optional component in the audio encoding system 100, which could alternatively be embodied with the first and further audio signals E1, E2, E3 as inputs.

The envelope analyzer 104 receives the first and further audio signals E1, E2, E3 from the combined spatial analyzer and adaptive rotation stage 106. The envelope analyzer 104 may receive a frequency-domain representation of the audio signals, in terms of transform coefficients inter alia, which may be the case if a time-to-frequency transform stage (not shown) is located further upstream in the processing path. Alternatively, the first and further audio signals E1, E2, E3 may be received as a time-domain representation from the combined spatial analyzer and adaptive rotation stage 106, in which case a time-to-frequency transform stage (not shown) may be arranged between the combined spatial analyzer and adaptive rotation stage 106 and the envelope analyzer 104. The envelope analyzer 104 outputs spectral envelopes of the signals EnvE1, EnvE2, EnvE3. The spectral envelopes EnvE1, EnvE2, EnvE3 may comprise energy or power values for a plurality of frequency subbands of equal or variable length. Such values may be obtained by summing transform coefficients (e.g., MDCT coefficients) corresponding to all spectral lines in the respective frequency bands, e.g., by computing an RMS value. With this setup, a spectral envelope of a signal will comprise values expressing the total energy in each frequency band of the signal. The envelope analyzer 104 may alternatively be configured to output the respective spectral envelopes EnvE1, EnvE2, EnvE3 as parts of a super-spectrum comprising juxtaposed individual spectral envelopes, which may facilitate subsequent processing.

The multichannel encoder 108 receives, from the optional combined spatial analyzer and adaptive rotation stage 106, the first and further audio signals E1, E2, E3 and optionally, to be able to enforce a total bitrate constraint, the bitrate $b_K$ required for encoding the decomposition parameters (d, ϕ, θ) in the bitstream B. The multichannel encoder 108 further receives, from the envelope analyzer 104, the spectral envelopes EnvE1, EnvE2, EnvE3 of the audio signals. Based on these inputs, the multichannel encoder 108 determines first rate allocation data, including parameters AllocOffsetE1 and AllocOverE1, for the first audio signal E1 and signal data DataE1, which may include quantization indices referring to the quantizers indicated by the first rate allocation rule, for the first audio signal E1. Similarly, the multichannel encoder 108 determines second rate allocation data, including parameters AllocOffsetE2E3 and AllocOverE2E3, for the further audio signals E2, E3 and signal data DataE2E3 for the further audio signals E2, E3. It is preferred that the rate allocation process operates on signals with flattened spectra. As will be described below, the flattening of the first signal E1 and the further signals E2 and E3 can be performed by normalizing the signals by values of their respective envelopes. The first rate allocation data and the signal data for the first audio signal are combined, by a basic-layer multiplexer 112, into a basic layer $B_{E1}$ to be included in the bitstream B which constitutes the output from the audio encoding system 100. Similarly, the second rate allocation data and the signal data for the further audio signals are combined, by a spatial-layer multiplexer 114, into a spatial layer $B_{spatial}$. The basic layer $B_{E1}$ and the spatial layer $B_{spatial}$ are combined by the final multiplexer 110 into the bitstream B. If the optional combined spatial analyzer and adaptive rotation stage 106 is included in the audio encoding system 100, the final multiplexer 110 may further include values the decomposition parameters (d, ϕ, θ).

Figure 2:
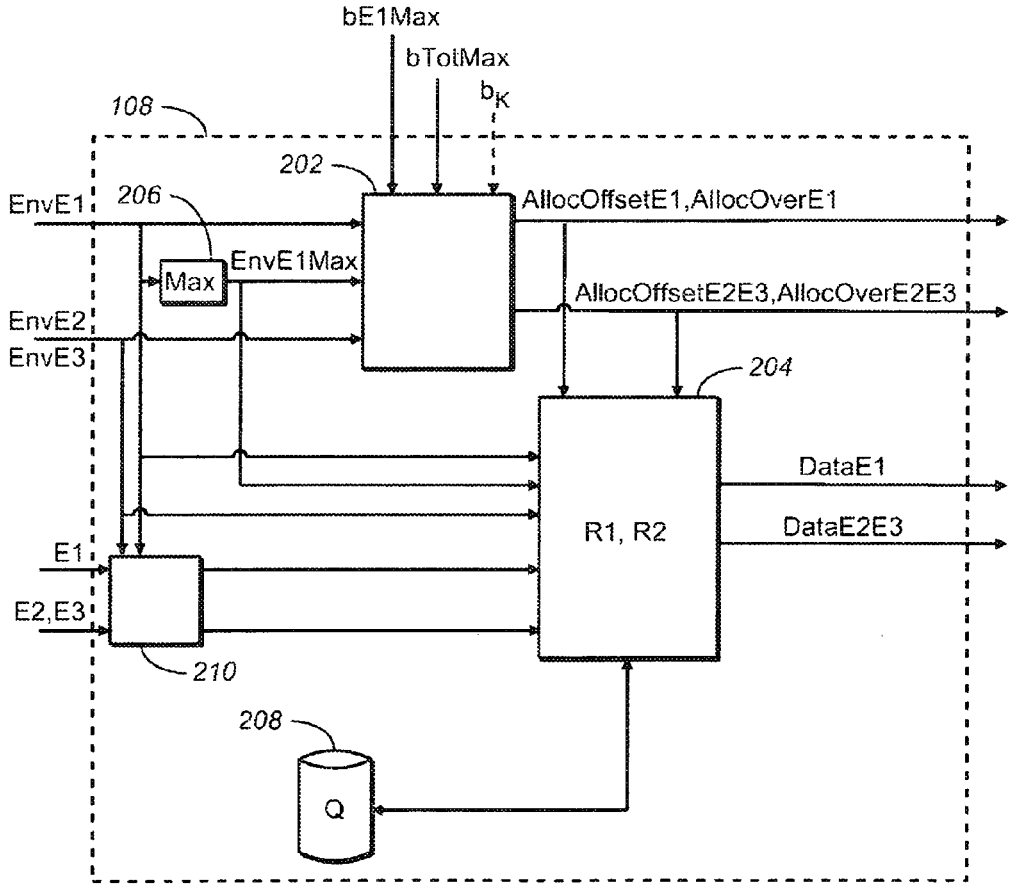
FIG. 2 shows a multichannel encoder suitable for inclusion in the audio encoding system in FIG. 1.

FIG. 2 shows the inner workings of the multichannel encoder 108, including a rate allocation component 202, a quantization component 204 implementing the first and second rate allocation rules R1, R2 and being arranged downstream of the rate allocation component 202, as well as a memory 208 for storing data representing a collection of predefined quantizers to which the first and second rate allocation rules R1, R2 refer. A processing component 206, which has been exemplified in FIG. 2 as a maximum operator, receives the spectral envelope EnvE1 of the first audio signal and computes, based thereon, a reference level EnvE1Max, which it supplies to the rate allocation component 202 and the quantization component 204. FIG. 2 further shows a flattening component 210, which rescales the first and further audio signals E1, E2, E3, in each frequency band, by the corresponding values of the spectral envelopes before the audio signals are supplied to the quantization component 204. As will be seen below, an inverse processing step to the spectral flattening may be applied on the decoding side.

An $i^{th}$ quantizer in the collection may be represented as a finite vector of equally or unequally spaced quantization levels, $Q_i=(q_{i,1}, q_{i,2}, \ldots q_{i,N(i)})$, where $a_i \le q_{i,1} < q_{i,2} < \ldots < q_{i,N(i)} \le b_i$, $[a_i, b_i]$ is the quantizable signal range, and N(i) the number of quantization levels of the $i^{th}$ quantizer. Because the average step size is inversely proportional to the number of quantization levels N(i) (ignoring that the quantizable signal range $[a_i, b_i]$ may vary between quantizers), this number may be understood as a measure of the fineness of the quantizer. The quantizers in the collection are ordered with respect to fineness if they are labelled in such manner that N(i) is a non-decreasing function of i. A sequence of M signal values in [a, b] that approximate a sequence of quantization levels $(q_{i,k(m)})_{m=1}^{M}$ can be expressed, with reference to the $i^{th}$ quantizer, as the sequence of quantization indices $(k(m))_{m=1}^{M}$, which may below be referred to simply as "indices" at times. Knowledge of the label i, which identifies the quantizer, is clearly required to restore the sequence of signal values in terms of the quantization levels. In this disclosure, a sequence of quantization indices generated during quantization of an audio signal will be referred to as signal data DataE1, DataE2E3, and this term will also be used for the indices converted into binary codewords. The mapping from quantization index to a codeword is one-to-one. The particular mapping function that is used is associated with the quantizer label uniquely. For example, for each quantizer label there can be a predetermined Huffman codebook mapping uniquely each possible value of quantization index to a Huffman codeword. The rate allocation component 202 determines the label i of a quantizer to be used for quantizing a $j^{th}$ frequency band the first audio signal E1 by modifying a parameter AllocOffsetE1, to be included in the first rate allocation data, which controls a first rate allocation rule R1:

$$i=R1(j,\mathrm{Env}E1,\mathrm{Env}E1\mathrm{Max};\mathrm{AllocOffset}E1).$$

In example embodiments, the first rate allocation rule may be defined as $$R1(j,\mathrm{Env}E1,\mathrm{Env}E1\mathrm{Max};\mathrm{AllocOffset}E1)=\mathrm{Env}E1(j)-\mathrm{Env}E1\mathrm{Max}+\mathrm{AllocOffset}E1.$$

With this definition, where the spectral envelope values EnvE1($j$) are quantized into integers and the offset parameter AllocOffsetE1 normalizes the spectral envelope values, the rate allocation component 202 may control the total coding bitrate expense by varying AllocOffsetE1. Furthermore, due to the term EnvE1($j$), relatively more coding bitrate will be allocated to frequency bands with relatively higher energy content. In this example, it may be expected that the difference of the two first terms, EnvE1($j$)−EnvE1Max, is close to zero or is a small negative number for most frequency bands. The fact that the first rate allocation rule refers to the energy content (spectral envelope values) normalized by the reference level makes it possible to encode AllocOffsetE1, as part of the bitstream B, at low coding expense.

Similarly, but with a notable difference, the rate allocation component 202 may determine the label i of the quantizer for the $j^{th}$ frequency band of a further audio signal E2, and hence the bitrate allocated to the coding of that frequency band, by varying a parameter AllocOffsetE2 in a second rate allocation rule R2:

$$i=R2(j,\mathrm{Env}E2,\mathrm{Env}E1\mathrm{Max};\mathrm{AllocOffset}E2).$$

Although this rule controls the rate allocation of one of the further audio signals, it preferably depends on the reference level EnvE1Max derived from the spectral envelope EnvE1 of the first audio signal E1. For instance, one may have:

$$R2(j,\mathrm{Env}E2,\mathrm{Env}E1\mathrm{Max};\mathrm{AllocOffset}E2)=\mathrm{Env}E2(j)-\mathrm{Env}E1\mathrm{Max}+\mathrm{AllocOffset}E2.$$

In example embodiments, the rate allocation rules R1, R2 can be overridden, for the first and/or the further audio signal, in a subset of the frequency, bands indicated by an augmentation parameter AllocOverE1, AllocOverE2E3 in the first or second rate allocation data. For instance, it may be agreed between an encoding and a decoding side that in all frequency bands with j≤AllocOverE1, an $(i+1)^{th}$ quantizer is to be chosen in place of the $i^{th}$ quantizer indicated for that frequency band by the first or second rate allocation rule. A single augmentation parameter AllocOverE2E3 may be defined for all further audio signal together. This allows for a finer granularity of the rate allocation.

Furthermore, it is possible to include a zero-rate quantizer in the collection of quantizers. A zero-rate quantizer encodes the signal without regard to the values of the signal; instead the signal may be synthesized at decoding, e.g., reconstructed by noise filling. It may be convenient to agree that all labels below a predefined constant, such as i≤0, are associated with the zero-level quantizer. The rate allocation component's 202 fixing of AllocOffsetE1 in the first rate allocation rule R1 will then implicitly indicate a subset of frequency bands for which no signal data are produced; the subset of frequency bands to be coded at zero rate will be empty if AllocOffsetE1 is increased sufficiently, so that $$R1(j,\mathrm{Env}E1,\mathrm{Env}E1\mathrm{Max};\mathrm{AllocOffset}E1)\text{ is positive for all }j.$$

Figure 3:
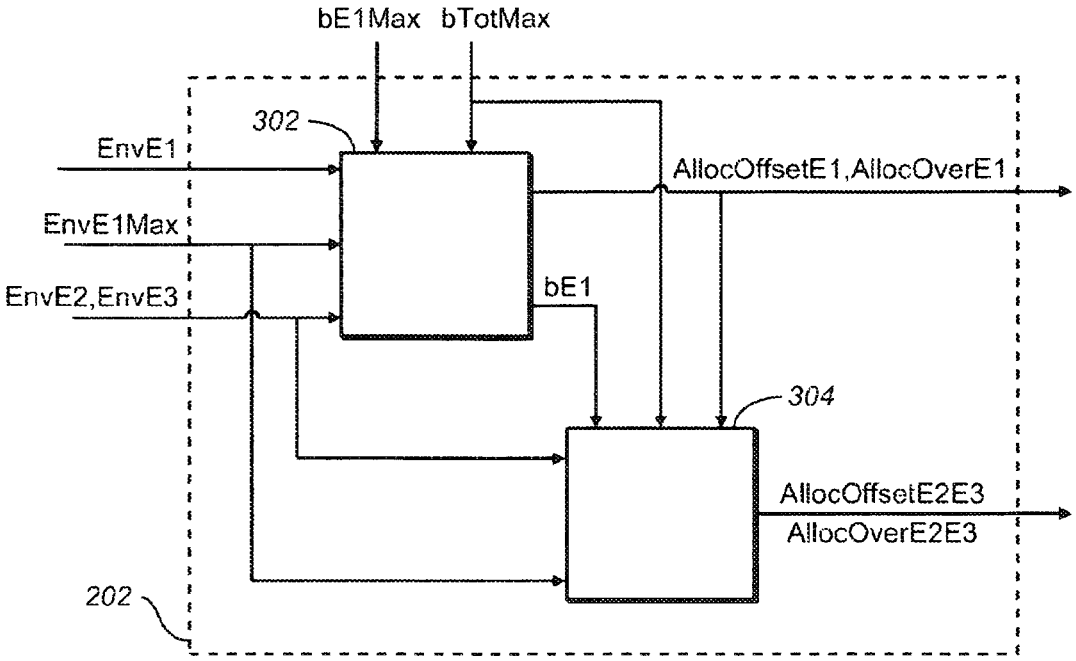
FIG. 3 shows a rate allocation component suitable for inclusion in the multichannel encoder in FIG. 2.

FIG. 3 shows a possible internal structure of the rate allocation component 202 implemented to observe both a basic-layer bitrate constraint bE1≤bE1Max and a total bitrate constraint bTot≤bTotMax. The first rate allocation data, which are exemplified in FIG. 3 by an offset parameter AllocOffsetE1 and an augmentation parameter AllocOverE1, are determined by a first subcomponent 302, whereas a second subcomponent 304 is entrusted with the assigning of the second rate allocation data, which have a similar format. The second subcomponent 304 is arranged downstream of the first subcomponent 302, so that the former may receive an actual basic-layer bitrate bE1 allowing it to determine the remaining bitrate headroom in the time frame as input to the continued rate allocation process.

As FIG. 3 shows, the rate allocation algorithm may be seen as a two-stage procedure. First, the bits are distributed between the basic and the spatial layers of the bitstream. In this procedure, the total number of available bits is distributed, which results in finding two bit-rates bE1 and bTot−bE1 satisfying bE1≤bE1Max and bTot≤bTotMax. The first stage of the rate allocation process, performed in the first subcomponent 302, requires access to all the three envelopes EnvE1, EnvE2 and EnvE3. During this procedure, an intra-channel rate allocation for the first audio signal E1 is obtained and inter-channel rate allocation among the first audio signal E1 and the further audio signals E2 and E3 as a by-product. Further, since the offset parameters AllocOffsetE2 and AllocOffsetE3 of the further audio signals may be expected to be close to the offset parameter AllocOffsetE1 of the first audio signal in normal circumstances, the procedure also provides an initial guess on the intra-channel rate allocation for E2 and E3 is obtained. The first stage of the rate allocation procedure yields the two scalar parameters AllocOffsetE1 and AllocOverE1. Although all the envelopes are used at the encoder to determine the rate allocation for the first audio signal E1, the decoder only needs EnvE1 and values of the first rate allocation parameters in order to determine the rate allocation and thus perform decoding of the first audio signal E1.

In the second stage of the rate allocation algorithm, a rate allocation between E2 and E3 is decided (both intra-channel and inter-channel rate allocation), given the total available number of bits for these two channels. The second stage of the rate allocation, which may be performed in the second subcomponent 304, requires access to the envelopes EnvE2 and EnvE3 and the reference level EnvE1Max. The second stage of the rate allocation process yields the two scalar parameters AllocOffsetE2E3 and AllocOverE2E3 in the second rate allocation data. In this case, the decoder would need all the three envelopes to perform decoding of the further audio signals E2 and E3 in addition to the parameters AllocOffsetE2E3 and AllocOverE2E3.

Figure 4:
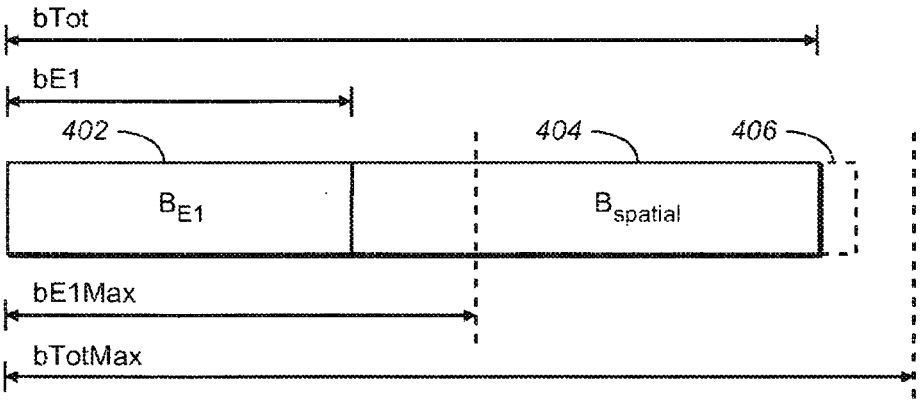
FIG. 4 shows a possible format, together with visualized bitrate constraints, for bitstream units in a bitstream produced according to an example embodiment or decodable according to an example embodiment.

FIG. 4 shows a possible format for bitstream units in the outgoing bitstream B. In tele- and videoconferencing applications, where convenience of mixing will imply a preference for frequency-domain representations of the audio signals, it is envisaged to use a relatively small packet length, which would comprise a single bitstream unit possibly corresponding to the transform stride of the time/frequency transform. By packet, it is here understood a network packet, e.g., a formatted unit of data carried by a packet-switched digital communication network. As such, each packet typically contains one bitstream unit corresponding to a single time frame of the audio signal. In each bitstream unit, a first portion 402 is said to belong to the basic layer $B_{E1}$ (enabling independent reconstruction of the first audio signal), and a second portion 404 belongs to the spatial layer $B_{spatial}$ (enabling reconstruction, possibly with the aid of data in the basic layer, of the at least one further audio signals). In FIG. 4, the actual bitrates bE1, bTot are drawn together with the respective bitrate constraints bE1Max, bTotMax. The bitstream unit may optionally be padded by a number of padding bits 406 to comprise an integer number of bytes. As the example bitstream unit in FIG. 4 illustrates, bE1 is smaller than bE1Max by a non-zero amount, so that the second portion 404 may begin earlier than the position located a distance bE1Max from the beginning of the bitstream unit.

Figure 5:
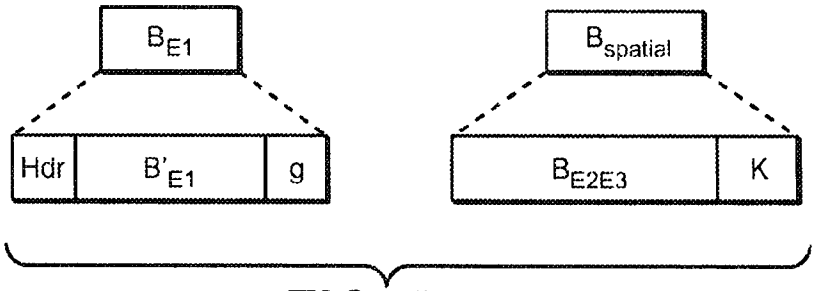
FIG. 5 shows details of the bitstream unit format in FIG. 4.

As FIG. 5 shows, the first portion 402 may comprise a header Hdr common to the entire bitstream unit, a basic-layer data portion $B'_{E1}$ and a gain profile g. The gain profile g may be used for noise suppression during mono decoding of the bitstream B, as described in detail in the referenced. The basic-layer data portion $B'_{E1}$ carries the (binarized) signal data DataE1 and the (binarized) spectral envelope EnvE1 of the first audio signal, as well as the first rate allocation data (also binarized). Further, the second portion 404 includes a spatial-layer data portion $B_{E2E3}$ and the decomposition parameters (d, ϕ, θ). The spatial-layer data portion $B_{E2E3}$ includes the signal data DataE2E3 and the spectral envelopes EnvE2, EnvE2 of the further audio signals, as well as the second rate allocation data. It is emphasized that the order of the blocks in the first portion 402 (other than possibly the header Hdr) and the blocks in the second portion 404 is not essential and may be varied with respect to what FIG. 5 shows without departing from the scope of protection.

Figure 6:
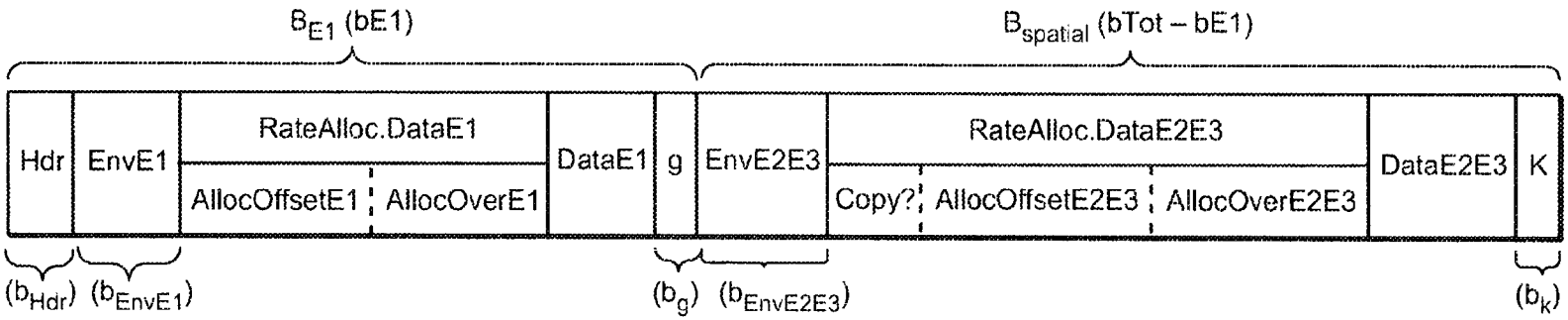
FIG. 6 shows a possible format for layer units in a bitstream produced according to an example embodiment or decodable according to an example embodiment.

FIG. 6 shows a packet comprising a single bitstream unit according to an example bitstream format, where the unit has additionally been annotated with the actual bitrates required to convey the header (bitrate: bHdr), the spectral envelope of the first audio signal (bEnvE1), the gain profile ($b_g$), the spectral envelopes of the at least one further audio signal (bEnvE2E3) and the decomposition parameters ($b_K$). As FIG. 6 shows, the first rate allocation data may comprise an offset parameter AllocOffsetE1 and an augmentation parameter AllocOverE1. The second rate allocation data may comprise a copy flag "Copy?", which if set indicates that the offset parameter in the first rate allocation data replace their counterparts in the second rate allocation data. If the copy flag is not set, then explicit values for the offset parameter AllocOffsetE2E3 in the second rate allocation data are included. It is recalled that the explicit values may be encoded as independently decodable values or in terms of their differences with respect to the counterpart parameters in the first rate allocation data. In some implementations, it may be preferred to place the beginning of the signal data DataE1, DataE2E3 at a dynamically variable location, in which case the signal data DataE1, DataE2E3 can be extracted from the bitstream B with certain knowledge. For instance, knowledge of the quantizers (or quantizer labels indicating the quantizers) that were used in the encoder-side quantization process may be sufficient to find the location of the signal data. It may be possible to determine the quantizers on the basis of spectral envelopes and the rate allocation data. In such implementations, it may be preferable to locate the first (or second) signal data after the first (or second) rate allocation data in sequence.

Figure 7:
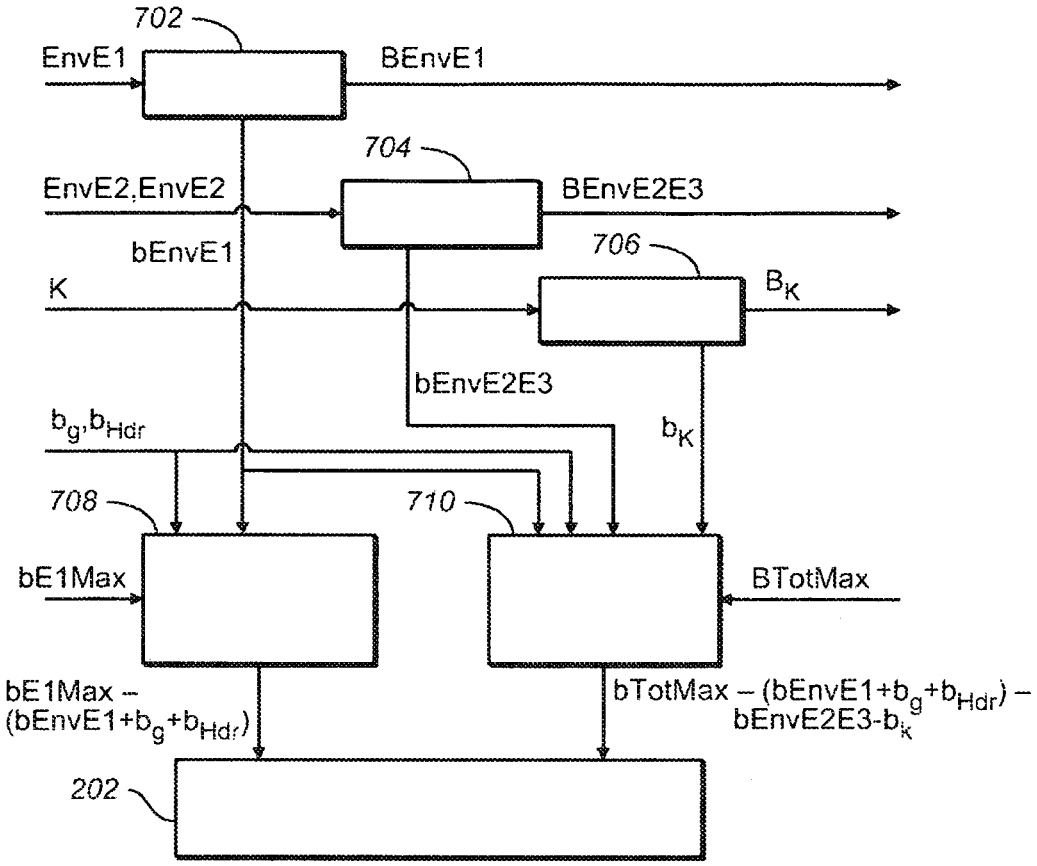
FIG. 7 shows, in the context of an audio encoding system, entities and processes providing input information to a rate allocation component according to an example embodiment.

FIG. 7 shows a possible algorithm which the rate allocation component 202 may follow in order to assign the quantizers while observing the basic-layer bitrate constraint and the total bitrate constraints discussed above. The spectral envelope EnvE1 of the first audio signal is encoded, in a process 702, as sub-bitstream BEnvE1, which occupies bitrate bEnvE1. Similarly, the spectral envelopes EnvE2, EnvE3 of the further audio signals are encoded, in a process 704, as sub-bitstream BEnvE2E3, which occupies bitrate bEnvE2E3. It is noted in this connection that the coding of a single spectral envelope may be frequency-differential; additionally or alternatively, the coding of the spectral envelopes of the audio signals may be channel-differential, e.g., the spectral envelope EnvE2 of a further audio signal is expressed in terms of its difference with respect to the spectral envelope EnvE1 of the first audio signal. Further, at a process 706, the decomposition parameters K=(d, ϕ, θ) are encoded as sub-bitstream $B_K$, at bitrate $b_K$. The bitrates bEnvE1, bEnvE2E3, $b_K$ may vary on a packet-to-packet basis, e.g., as a function of properties of the first and further audio signals. The bitrate $b_{Hdr}$ required to encode the header Hdr and the bitrate $b_g$ occupied by the gain profile g are typically independent of the first and further audio signals. Further inputs to the rate allocation algorithm are also the basic-layer constraint bE1Max and the total constraint bTotMax. When values of these quantities are given, a process 708 may compute the remaining basic-layer headroom as $\Delta bE1 = bE1Max - (bEnvE1 + b_g + b_{Hdr})$, and a process 710 may compute the remaining total headroom as $\Delta bTot = bTotMax - (bEnvE1 + b_g + b_{Hdr}) - bEnvE2E3 - b_K$. Based on these headrooms, the rate allocation component 202 may then determine the first rate allocation data in such manner that the additional bitrate required to encode the first rate allocation data and the signal data DataE1 for the first audio signal does not exceed ΔbE1. Similarly, the rate allocation component 202 may determine the second rate allocation data so that the additional bitrate required to encode the second rate allocation data and the signal data DataE2E3 for the further audio signal(s) does not exceed ΔbTot.

A rate allocation algorithm of the type outlined in the preceding paragraph may proceed by successively increasing the coding bitrate until either the basic-layer bitrate constraint or the total bitrate constraint is saturated. Formally, this is bE1=bE1Max or bTot=bTotMax, respectively. Alternatively, the rate allocation algorithm may attempt to assign the first and second rate allocation data in order to saturate, first, the basic-layer bitrate constraint, to assess whether the total bitrate constraint is observed, and, then, the total bitrate constraint, to assess whether the basic-layer bitrate constraint is observed.

Further alternatively, in the case where both the basic-layer bitrate constraint bE1Max and the total bitrate constraint bTotMax apply, the first rate allocation data may be determined by the approached described in International Patent Application No. PCT/EP2013/069607, namely based on a joint comparison of frequency bands of all spectral envelopes (or all frequency bands in a super-spectrum) while repeatedly estimating a first coding bitrate bE1 occupied by the basic layer $B_{E1}$ of the bitstream B. The joint comparison aims at finding a collection of those frequency bands, regardless of the audio signals they are associated with, that carry the greatest energy. After the first rate allocation data have been determined, the rate allocation component 202 proceeds differently depending on whether the basic-layer bitrate constraint was saturated:

a) if the basic-layer bitrate constraint was not saturated (bE1<bE1Max), the second rate allocation data are determined by the joint comparison of frequency bands of all spectral envelopes EnvE1, EnvE2, EnvE3; and b) if the basic-layer bitrate constraint was saturated (bE1≤bE1Max), the second rate allocation data are determined based on a joint comparison of frequency bands of the spectral envelope(s) EnvE2E3 of the further audio signals.

In a possible further development of this approach, the rate allocation component 202 may be configured not to saturate the total bitrate constraint by increasing the offset parameter AllocOffsetE2E3 in the second rate allocation data beyond the value of the offset parameter AllocOffsetE1 in the first rate allocation data. This would amount to spending coding bitrate in order to encode the further audio signals E2, E3 by means of finer quantizers than was used for the first audio signal E1. Since this is not likely to improve the perceived quality (e.g., it would not reduce the distortion), the audio encodings system 100 may save computational power and/or may decrease its use of total outgoing bandwidth by leaving AllocOffsetE2E3 equal to AllocOffsetE1.

In a possible implementation, the rate allocation unit 108, in particular the quantizer selector 202 and quantization component 204, is able to determine the actual consumption of bitrate by adjusting the respective values of the offset parameter AllocOffsetE1 in a first rate allocation procedure by:

i) selecting an initial value of the offset parameter AllocOffsetE1 in the first rate allocation data;

ii) performing spectral flattening of the first audio signal E1 and the further audio signals E2, E3 by rescaling in accordance with their respective envelopes EnvE1, EnvE2, EnvE3;

iii) performing rate allocation on the basis of all available envelopes and the reference level EnvE1Max, which yields quantizer labels indicating quantizers for respective frequency bands of the first audio signal E1 and the further audio signals E2, E3. This is to say, the quantizer labels for the further audio signals E2, E3 are found by evaluating the second rate allocation rule R2 with the offset parameter AllocOffsetE1 in the first rate allocation data in the place of the offset parameter AllocOffsetE2 in the second rate allocation data. This step is preferably performed in the quantizer selector 202;

iv) applying quantizers indicated by the respective quantizers to the respective bands of respective flattened audio signals and determining the quantization indices and the related codeword lengths. This step is preferably performed in the quantization component 204; and v) determining the total bitrate bTot and bitrate bE1 for the layer with the first audio signal that results from the value of AllocOffsetE1. The quantization component 204 typically has access to all or most of the data necessary to determine the bitrates, as suggested by FIG. 7; alternatively, a different component in the multichannel encoder 108 may gather the information and determine the basic-layer bitrate and the total bitrate.

In a second rate allocation procedure similar to the above steps i-v, the rate allocation unit 108 is able to determine the value of the offset parameter AllocOffsetE2E3 in the second rate allocation data, possibly using the final value of the offset parameter AllocOffsetE1 in the first rate allocation data as an initial value. However, although this second procedure uses the reference level EnvE1Max, it does not need the first audio signal E1 and its spectral envelope EnvE1. The adjustment of the rate allocation can be implemented by means of a binary search aiming at adjusting the offset parameters AllocOffsetE1, AllocOffsetE2E3. In particular, the adjustment may include a loop over above steps iii-v with the aim of spending as many of the available coding bits as possible while respecting the basic-layer bitrate constraint bE1Max and the total bitrate constraint bTotMax.

Figure 8:
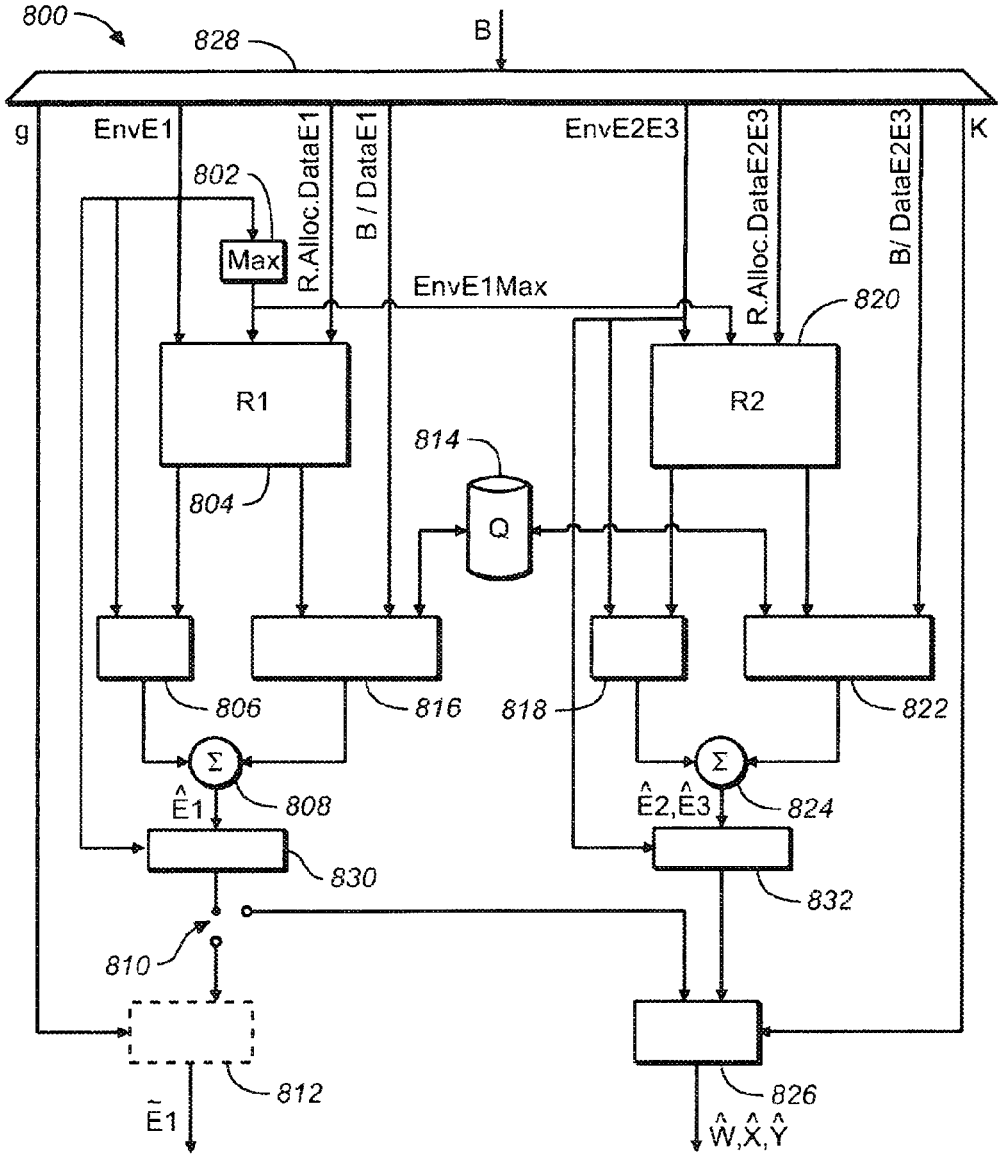
FIG. 8 is a generalized block diagram of an multichannel-enabled audio decoding system according to an example embodiment.

FIG. 8 schematically depicts, according to an example embodiment, a multichannel audio decoding system 800, which if an optional switch 810 and final cleaning stage 812 are provided, is operable in a mono decoding mode, in addition to a multichannel decoding mode where the system 800 reconstructs a first audio signal E1 and at least one further audio signal, here exemplified as two further audio signals E2, E3. In the mono decoding mode, the system 800 reconstructs the first audio signal E1 only.

In the system 800, a demultiplexer 828 extracts the following data from an incoming bitstream B: an optional gain profile g for post-processing in mono decoding mode, a spectral envelope EnvE1 of the first audio signal, first rate allocation data "R. Alloc. Data E1", signal data DataE1 of the first audio signal, spectral envelopes EnvE2, EnvE3 of the further audio signals, second rate allocation data "R. Alloc. Data E2E3", signal data DataE2E3 of the further audio signals, and finally decomposition parameters K=(d, $\phi$, $\theta$) enabling a rotation inversion stage 826 in the system 800 to apply an inverse of an energy-compacting transform performed at an early processing stage on the encoding side. The spectral envelopes EnvE2, EnvE3 of the further audio signals may be decoded while relying on the spectral envelope EnvE1 of the first audio signal (e.g., differentially). Further, the second rate allocation data may be decoded while relying on the first rate allocation data (e.g., differentially, or by copying all or portions of the first rate allocation data). In variations to the example embodiment shown in FIG. 8, the demultiplexer 828 may be implemented as plural sub-demultiplexers arranged in parallel or cascaded, similar to the multiplexer arrangement at the downstream end of the audio encoding system 100 shown in FIG. 1.

The audio decoding system 800 downstream of the demultiplexer 828 may be regarded as divided into a first section responsible for the reconstruction of the first audio signal E1, a second section responsible for the reconstruction of the further audio signals E2, E3, and a post-processing section. A memory 814 storing a collection of predefined inverse quantizers is shared between the first and second sections. Also shared between these sections is a processing component 802 implementing a non-zero predefined functional for deriving a reference level EnvE1Max on the basis of the spectral envelope EnvE1 of the first audio signal. The predefined inverse quantizers and the functional are in agreement with those used in an encoding entity preparing the bitstream B. In particular, the reference level may be the maximum value or the mean value of the spectral envelope EnvE1 of the first audio signal.

In the first section, a first inverse quantizer selector 804 indicates an inverse quantizer for each frequency band of the first audio signal. The first inverse quantizer selector 804 implements the first rate allocation rule R1. For the bands to be reconstructed by inverse quantization based on the first signal data DataE1, control data are sent to a first dequantization component 816, which retrieves the indicated inverse quantizers from the memory 814 and reconstructs these frequency bands of the first audio signal, inter alia by mapping quantization indices to quantization levels. As the alternative notation "B/DataE1" suggests, the dequantization component 816 may receive the bitstream B, since in some implementations knowledge of the quantizer labels—which the demultiplexer 828 typically lacks—is required to correctly extract the signal data DataE1 from the bitstream B. In particular, the location of the beginning of the signal data DataE1 may be dependent on the quantizer labels. In such implementations, the dequantization component 816 and the demultiplexer 828 jointly act as a "demultiplexer" in the sense of the claims. The remaining frequency bands of the first audio signal, which are to be reconstructed by noise filling, are indicated to a noise-fill component 806, which additionally receives the spectral envelope EnvE1 of the first audio signal and outputs, based thereon, reconstructed frequency bands. A first summer 808 concatenates the reconstructed frequency bands from the noise-fill component 806 and the first dequantization component 816 into a reconstructed first audio signal $\hat{E}_1$. In some example embodiments, like the one shown in FIG. 8, there is a subsequent processing step, implemented by a first de-flattening component 830, which restores the original dynamic range by rescaling in accordance with the respective spectral envelopes of the audio signals, thus performing an approximate inverse of the operations in the flattening component 210.

The second section includes a corresponding arrangement of processing components, including a second inverse quantizer selector 820, a second dequantization component 822 (which may, similarly to the first dequantization component 816, receive the bitstream B rather than pre-extracted signal data DataE2E3 for the further audio signal), a noise-filling component 818, and a summer 824 for concatenating the reconstructed frequency bands of each reconstructed audio signal $\hat{E}_2$, $\hat{E}_3$. In some example embodiments, including the one of FIG. 8, the output of the summer 824 is de-flattened by means of a second de-flattening component 832.

The processing component 802, the first and second inverse quantizer selectors 804, 820, the first and second dequantization components 816, 822, the noise-filling components 806, 818 and the summers 808, 824 together form a multichannel decoder.

In the post-processing stage of the multichannel audio decoding system 800, the rotation inversion stage 826, which is active when the switch 810 immediately downstream of the first summer 810 is in an upper position (corresponding to a multichannel decoding mode), maps the reconstructed audio signals $\hat{E}_1$, $\hat{E}_2$, $\hat{E}_3$ using an orthogonal transformation into an equal number of output audio signals $\hat{W}$, $\hat{X}$, $\hat{Y}$. The orthogonal transformation may be an inverse or approximate inverse of an energy-compacting orthogonal transform performed at encoding.

If the switch 810 is in its lower position (as may be the case in the mono decoding mode, the reconstructed first audio signal $\hat{E}_1$ is filtered in the cleaning stage 812 before being output from the system 800. Quantitative characteristics of the cleaning stage 812 are controllable by the gain profile g which is optionally decoded from the bitstream B.

Figure 9:
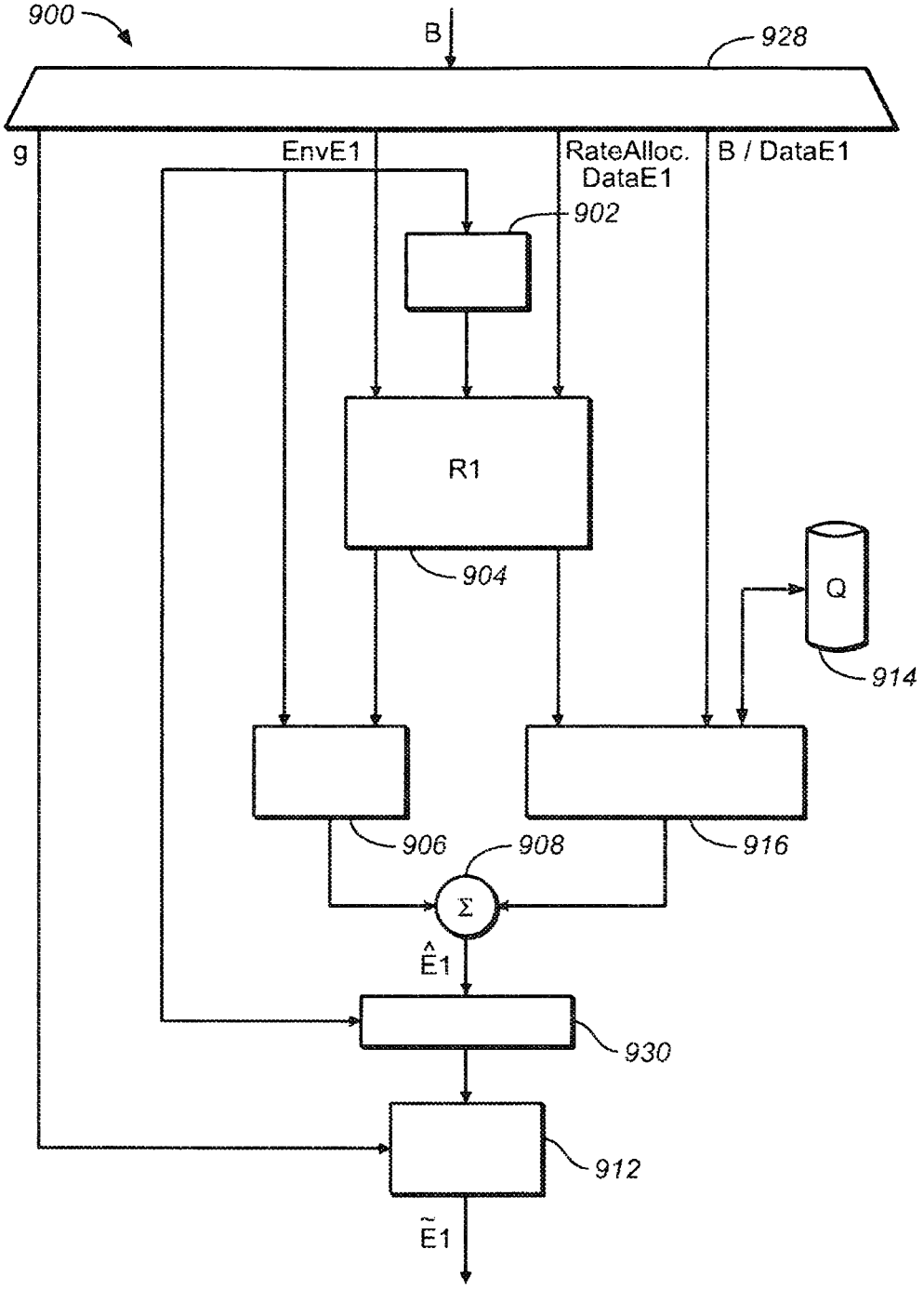
FIG. 9 is a generalized block diagram of a mono audio decoding system according to an example embodiment.

FIG. 9 shows an example embodiment within the decoding aspect, namely a mono audio decoding system 900. The mono audio decoding system 900 may be arranged in legacy equipment, such as a conferencing endpoint with only mono playback capabilities. On a high level, the mono audio decoding system 900 downstream of its demultiplexer 928, may be described as a combination of the first section, the shared components and the mono portion of the post-processing section in the multichannel audio decoding system 800 previously described in connection with FIG. 8.

The demultiplexer 928 extracts a spectral envelope EnvE1 of the first audio signal from the bitstream B and supplies this to a processing component 902, an inverse quantizer selector 904 and a noise-filling component 906. Similar to the processing component 802 in the multichannel audio decoding system 800, the processing component 902 implements a predefined non-zero functional, which based on the spectral envelop EnvE1 of the first audio signal provides the reference level EnvE1Max, to which the first rate allocation rule R1 refers. The inverse quantizer selector 904 receives the reference level, the spectral envelope EnvE1 of the first audio signal, and first rate allocation data extracted by the demultiplexer 928 from the bitstream B, and selects predefined inverse quantizers from a collection stored in a memory 914. A dequantization component 916 dequantizes, similar to the dequantization component 816 in the multichannel audio decoding system 800, signal data DataE1 for the first audio signal, which the dequantization component 916 is able to extract from the bitstream B (hence acting as a demultiplexer in one sense) after it has determined the quantizer labels. The dequantization may comprise decoding of quantization indices by using inverse quantizers indicated by the first rate allocation rule R1, which the quantizer selector 904 evaluates in order to identify the inverse quantizers and the associated codebooks, wherein a codebook determines the relationship between quantization indices and binary codewords. A noise-filling component 906, summer 908, an optional de-flattening component 930 and cleaning stage 912 perform functions analogous to those of the noise-filling component 806, summer 808, the optional de-flattening component 830 and cleaning stage 812 in the multichannel audio decoding system 800, to produce the reconstructed first audio signal $\hat{E}_1$ and optionally a de-flattened version thereof.

III. Equivalents, Extensions, Alternatives and Miscellaneous

Further example embodiments will become apparent to a person skilled in the art after studying the description above. Even though the present description and drawings disclose embodiments and examples, the scope is not restricted to these specific examples. Numerous modifications and variations can be made without departing from the scope, which is defined by the appended claims. Any reference signs appearing in the claims are not to be understood as limiting their scope.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and non-volatile, removable and nonremovable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

The invention claimed is:

1. A scalable adaptive audio encoding system, comprising:

an envelope analyzer for outputting spectral envelopes on the basis of a time frame of a frequency-domain representation of a first audio signal (E1) and at least one further audio signal (E2, E3), wherein the first audio signal and the at least one further audio signal correspond to signals in a spatial sound field captured by an array of three or more microphones;

a multichannel encoder including:

a rate allocation component for determining:

first rate allocation data indicating, in a collection of predefined quantizers, quantizers for respective frequency bands of the first audio signal; and second rate allocation data indicating, in a collection of predefined quantizers, quantizers for respective frequency bands of the at least one further audio signal; and a quantization component configured to retrieve the quantizers indicated by the rate allocation component and to quantize the first audio signal and the at least one further audio signal using the quantizers thus retrieved, and to output signal data; and a multiplexer for outputting a bitstream (B) comprising the spectral envelopes, the signal data and the rate allocation data, wherein the rate allocation component is configured with a first rate allocation rule (R1), by which the first rate allocation data, the spectral envelope of the first audio signal (EnvE1) and a reference level (EnvE1Max) derived from the spectral envelope of the first audio signal using a predefined non-zero functional determine the quantizers for the first audio signal, and with a second rate allocation rule (R2), by which the second rate allocation data, the spectral envelope of the at least one further audio signal (EnvE2, EnvE3) and said reference level (EnvE1Max) derived from the first audio signal determine the quantizers for the at least one further audio signal.

2. The audio encoding system of claim 1, wherein the multiplexer is configured to form a bitstream with a basic layer ($B_{E1}$) and a spatial layer ($B_{spatial}$), wherein the basic layer comprises the spectral envelope and the signal data of the first audio signal and the first rate allocation data, and allows independent reconstruction of the first audio signal.

3. The audio encoding system of claim 2, wherein the rate allocation component is configured to determine a first coding bitrate (bE1) occupied by the basic layer of the bitstream and to determine the first rate allocation data subject to a basic-layer bitrate constraint (bE1max).

4. The audio encoding system of claim 2, wherein the rate allocation component is configured to determine a total coding bitrate (bTot) occupied by the bitstream and to determine the first and second rate allocation data subject to a total bitrate constraint (bTotMax).

5. The audio encoding system of claim 3, wherein the rate allocation component is configured to:

determine the first rate allocation data based on a joint comparison of frequency bands of all spectral envelopes while repeatedly estimating a first coding bitrate (bE1) occupied by the basic layer of the bitstream, wherein the first rate allocation data are determined subject to a basic-layer bitrate constraint (bE1Max) or, if the basic-layer bitrate constraint is not saturated, subject to a total bitrate constraint (bTot); and determine the second rate allocation data subject to the total bitrate constraint (bTot) and in dependence of whether the basic-layer bitrate constraint was saturated, wherein, if the basic-layer bitrate constraint was not saturated, the second rate allocation data are determined by the joint comparison of frequency bands of all spectral envelopes; and if the basic-layer bitrate constraint was saturated, the second rate allocation data are determined based on a joint comparison of frequency bands of the spectral envelope(s) of the at least one further audio signal.

6. The audio encoding system of claim 1, wherein:

the collection of predefined quantizers is ordered with respect to fineness; and the first and/or second rate allocation rule is/are designed to indicate a finer quantizer for a frequency band with higher energy content than a frequency band of the same signal with lower energy content, as indicated by the respective spectral envelope.

7. The audio encoding system of claim 6, wherein the first and/or second rate allocation rule is/are designed to refer to the energy content normalized by the reference level (EnvE1Max) derived from the first audio signal.

8. The audio encoding system of claim 6, wherein:

the rate allocation data include an offset parameter (AllocOffsetE1, AllocOffsetE2E3); and the first and/or second rate allocation rule is designed to refer to the energy content normalized by the offset parameter.

9. The audio encoding system of claim 6, wherein the rate allocation data further includes an augmentation parameter (AllocOverE1, AllocOverE2E3) indicating a subset of the frequency bands for which the first/and or second rate allocation rule is overridden.

10. The audio encoding system of claim 1, wherein the multiplexer is configured to output a bitstream comprising bitstream units corresponding to one or more time frames of the audio signals, in which the spectral envelope and signal data of the first audio signal and the first rate allocation data are non-interlaced with the spectral envelopes and signal data of the at least one further audio signal and the second rate allocation data in each bitstream unit.

11. The audio encoding system of claim 10, wherein the multiplexer is configured to output a bitstream comprising bitstream units in which the spectral envelope and signal data of the first audio signal and the first rate allocation data precede the spectral envelopes and signal data of the at least one further audio signal and the second rate allocation data in each bitstream unit.

12. The audio encoding system of claim 10, wherein the multiplexer is configured to output a bitstream of bitstream units which further comprise a gain profile (g) for noise suppression in connection with mono decoding, wherein the gain profile precedes the spectral envelopes and signal data of the at least one further audio signal and the second rate allocation data in each bitstream unit.

13. The audio encoding system of claim 1, further comprising:

a spatial analyzer configured to receive a plurality of input audio signals (W, X, Y) and to determine, based on these, frame-wise decomposition parameters (K=(d, ϕ, θ)); and an adaptive rotation stage configured to receive said plurality of input audio signals and to output said plurality of audio signal (E1, E2, E3) by applying an energy-compacting orthogonal transformation, wherein quantitative properties of the transformation are determined by the decomposition parameters.

14. An audio encoding method comprising:

generating spectral envelopes (EnvE1, EnvE2, EnvE3) on the basis of a time frame of a frequency-domain representation of a first audio signal (E1) and at least one further audio signal (E2, E3), wherein the first audio signal and the at least one further audio signal correspond to signals in a spatial sound field captured by an array of three or more microphones;

determining first rate allocation data indicating, in a collection of predefined quantizers, quantizers for respective frequency bands of the first audio signal;

determining second rate allocation data indicating, in a collection of predefined quantizers, quantizers for respective frequency bands of the at least one further audio signal;

quantizing the first audio signal and the at least one further audio signal using the quantizers indicated by the first and second rate allocation data, thereby obtaining signal data (DataE1, DataE2E3); and forming a bitstream (B) comprising the spectral envelopes, the signal data and the first and second rate allocation data, the method comprising the further step of computing a reference level (EnvE1Max) by mapping the spectral envelope of the first audio signal under a predefined non-zero functional, wherein:

the first rate allocation data are determined by evaluating a predefined first allocation rule (R1), by which the first rate allocation data, the spectral envelope of the first audio signal and said reference level determine the quantizers for the first audio signal; and the second rate allocation data are determined by evaluating a predefined second allocation rule (R2), by which the second rate allocation data, the spectral envelope of the at least one further audio signal audio signal and said reference level determine the quantizers for the at least one further audio signal.

15. A multichannel audio decoding method, comprising:

receiving spectral envelopes (EnvE1, EnvE2, EnvE3) of a first audio signal and of at least one further audio signal, signal data of the first (DataE1) and further (DataE2E3) audio signals, and first and second rate allocation data, wherein the first audio signal and the at least one further audio signal correspond to signals in a spatial sound field captured by an array of three or more microphones;

indicating, in a collection of predefined inverse quantizers, inverses quantizers for respective frequency bands of the first audio signal and inverse quantizers for respective frequency bands of the at least one further audio signal; and reconstructing the frequency bands of the first and further audio signals based on the signal data and using the indicated inverse quantizers, the method comprising the further step of computing a reference level (EnvE1Max) by mapping the spectral envelope of the first audio signal under a predefined non-zero functional, wherein said indication of inverse quantizers includes applying a first rate allocation rule (R1), by which the first rate allocation data, the spectral envelope of the first audio signal (EnvE1) and said reference level (EnvE1Max) determine the inverse quantizers for the first audio signal, and further applying a second rate allocation rule (R2), by which the second rate allocation data, the spectral envelopes of the at least one further audio signal (EnvE2, EnvE3) and said reference level (EnvE1Max) determine the inverse quantizers for the at least one further audio signal.

16. A multichannel audio decoding system for reconstructing a first audio signal and at least one further audio signal on the basis of a bitstream (B), the system comprising:

a demultiplexer for receiving the bitstream and extracting therefrom spectral envelopes of the first (EnvE1) and further (EnvE2, EnvE3) audio signals, signal data of the first and further audio signals, and first and second rate allocation data, wherein the first audio signal and the at least one further audio signal correspond to signals in a spatial sound field captured by an array of three or more microphones;

a multichannel decoder including:

an inverse quantizer selector for indicating, in a collection of predefined inverse quantizers, inverse quantizers for respective frequency bands of the first audio signal and inverse quantizers for respective frequency bands of the at least one further audio signal; and a dequantization component configured to retrieve the inverse quantizers indicated by the inverse quantizer selector and to reconstruct the frequency bands of the first and further audio signals based on the signal data and using the inverse quantizers thus retrieved, wherein the multichannel decoder further includes a processing component for determining a reference level (EnvE1Max) by mapping the spectral envelope of the first audio signal under a predefined non-zero functional, and wherein the inverse quantizer selector is configured with a first rate allocation rule (R1), by which the first rate allocation data, the spectral envelope of the first audio signal (EnvE1) and said reference level (EnvE1Max) determine the inverse quantizers for the first audio signal, and with a second rate allocation rule (R2), by which the second rate allocation data, the spectral envelopes of the at least one further audio signal (EnvE2, EnvE3) and said reference level (EnvE1Max) determine the inverse quantizers for the at least one further audio signal.

17. The audio decoding system of claim 16, wherein:

the collection of inverse quantizers includes a zero-rate inverse quantizer; and the multichannel decoder further comprises a noise-fill component configured to reconstruct frequency bands for which any of the rate allocation rules (R1, R2) indicates said zero-rate inverse quantizer.

18. The audio decoding system of claim 16, wherein the multichannel decoder is configured to decode the spectral envelopes (EnvE2, EnvE3) of the at least one further audio signal differentially with reference to the spectral envelope (EnvE1) of the first audio signal.

19. The audio decoding system of claim 16, wherein the demultiplexer is further configured to extract decomposition parameters (d, $\phi$, $\theta$) from the bitstream, the system further comprising an adaptive rotation inversion stage configured to receive the decomposition parameters and the reconstructed first and further audio signals ($\hat{E}_1$, $\hat{E}_2$, $\hat{E}_3$), and to output a plurality of output audio signals ($\hat{W}$, $\hat{X}$, $\hat{Y}$) by applying an orthogonal transformation, wherein quantitative properties of the transformation are determined by the decomposition parameters.

20. A non-transitory computer program product comprising a computer-readable medium with instructions for causing a computer to execute the method of claim 14 or 15.

21. A mono audio decoding system for reconstructing a first audio signal on the basis of a bitstream, the system comprising:

a demultiplexer for receiving the bitstream and extracting therefrom a spectral envelope (EnvE1) of the first audio signal, signal data of the first audio signal and first rate allocation data, wherein the first audio signal corresponds to a signal in a spatial sound field captured by an array of three or more microphones;

a mono decoder including:

a processing component for determining a reference level (EnvE1Max) by mapping the spectral envelope of the first audio signal under a predefined non-zero functional, wherein the predefined non-zero functional is proportional to a mean value operator, wherein the mean value operator is an average of signed band-wise values of the spectral envelope of the first audio signal;

an inverse quantizer selector for indicating, in a collection of predefined inverse quantizers, inverse quantizers for respective frequency bands of the first audio signal, wherein the inverse quantizer selector is configured with a first rate allocation rule (R1), by which the first rate allocation data, the spectral envelope of the first audio signal (EnvE1) and said reference level (EnvE1Max) determine the inverse quantizers for the first audio signal; and a dequantization component configured to retrieve the inverse quantizers indicated by the inverse quantizer selector and to reconstruct the frequency bands of the first audio signal based on the signal data and using the inverse quantizers thus retrieved, wherein the demultiplexer is layer-selective, whereby it omits any spectral envelope, signal data and rate allocation data relating to other than the first audio signal.

22. The audio decoding system of claim 21, wherein the demultiplexer is further configured to extract a gain profile (g) from the bitstream, the system further comprising a cleaning stage adapted to receive the gain profile and a reconstructed first audio signal ($\hat{E}_1$) and to output a modified first audio signal ($\tilde{E}_1$) by applying the gain profile to the reconstructed first audio signal.

* * * * *